US006755618B2

(12) United States Patent
Munshi et al.

(10) Patent No.: US 6,755,618 B2
(45) Date of Patent: Jun. 29, 2004

(54) STEAM TURBINE CLOSURE BUCKET ATTACHMENT

(75) Inventors: Jonathan Munshi, Scotia, NY (US); John Cleland Lavash, Niskayuna, NY (US); William David Moore, Rensselaer, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/277,935

(22) Filed: Oct. 23, 2002

(65) Prior Publication Data

US 2004/0081558 A1 Apr. 29, 2004

(51) Int. Cl.[7] ..... F01D 5/32
(52) U.S. Cl. ..... 416/220 R; 416/222
(58) Field of Search ..... 416/220 R, 222

(56) References Cited

U.S. PATENT DOCUMENTS

| | | | | | |
|---|---|---|---|---|---|
| 913,273 | A | * | 2/1909 | Emden | 416/222 |
| 926,442 | A | * | 6/1909 | Smoot | 416/222 |
| 1,360,936 | A | * | 11/1920 | Lewis | 416/222 |
| 2,221,685 | A | * | 11/1940 | Smith | 416/222 |
| 4,400,137 | A | | 8/1983 | Miller et al. | |
| 4,702,673 | A | | 10/1987 | Hansen et al. | |
| 4,781,532 | A | | 11/1988 | Novacek et al. | |
| 4,878,811 | A | | 11/1989 | Jorgensen | |
| 5,062,769 | A | | 11/1991 | Ortolano | |
| 5,509,784 | A | | 4/1996 | Caruso et al. | |
| 6,030,178 | A | | 2/2000 | Caruso | |
| 6,158,104 | A | | 12/2000 | Roberts et al. | |
| 6,416,286 | B1 | | 7/2002 | Roberts et al. | |
| 6,428,279 | B1 | | 8/2002 | Reluzco et al. | |

FOREIGN PATENT DOCUMENTS

| | | | | |
|---|---|---|---|---|
| JP | 60079105 A | * | 5/1985 | F01D/5/32 |
| JP | 60147504 A | * | 8/1985 | F01D/5/32 |

* cited by examiner

*Primary Examiner*—Edward K. Look
*Assistant Examiner*—Igor Kershteyn
(74) *Attorney, Agent, or Firm*—Nixon & Vanderhye P.C.

(57) ABSTRACT

A turbine wheel including a male dovetail configuration about substantially an entire periphery of the wheel, interrupted by a notch formed by removal of portions of the male dovetail at a bucket loading location on the periphery of the wheel. A closure bucket adapted for loading onto the wheel includes a root portion, a platform and airfoil, the root portion formed with a pair of radially inwardly extending laterally spaced tangs, the tangs each formed with a pair of radially aligned retaining pin holes, the retaining pin holes located radially inwardly of the male dovetail configuration.

7 Claims, 3 Drawing Sheets

STEAM TURBINE CLOSURE BUCKET ATTACHMENT

This invention relates to a method of attaching the final steam turbine bucket (also called the closure bucket) of a row of buckets on a turbine rotor or wheel.

BACKGROUND OF THE INVENTION

Steam turbine blades, or buckets, are often designed for installation on a turbine wheel in a tangential direction. The buckets are typically attached to the turbine wheel using external circumferential dovetails, with a male dovetail on the wheel periphery and a complimentary female dovetail in the base or root of the bucket. In order to load these buckets onto the wheel, a notch which locally removes the male dovetail portions is cut on the periphery of the wheel, leaving a generally rectangular core portion. Each bucket is then initially located over the core material in the notch and then displaced tangentially onto and around the wheel. Once all the buckets have been loaded, a closure block is utilized that is formed with laterally spaced tangs extending radially inwardly and that are adapted to straddle the core material in the notch. The closure block is secured by a retaining pin passing through the tangs and core. In this way, the buckets on the wheel are locked in place and thus prevent the buckets from moving circumferentially along the dovetail.

Front or first stage turbine buckets are subjected to high temperatures over 900° F. Limitations of material stress capability mean that only a lightweight block, which has no airfoil, can be used as the closure block, causing reduced performance. Because the closure block has no airfoil, there is an opening in the steam path with detrimental effects on performance. The reason behind the inability to support an airfoil on the closure bucket is the fact that the retaining pin passes through the core material in the highly stressed dovetail region of the wheel. There is thus a need for a first stage closure block with a mounting or retaining arrangement that provides sufficient strength to permit the incorporation of an integral airfoil that closes the opening, thus producing greater performance.

BRIEF DESCRIPTION OF THE INVENTION

The new closure bucket design in accordance with this invention has two longer tangs which fit into a radially extended loading notch in the wheel. Two axial pins pass through the tangs and a remaining core portion of the wheel, but radially inside the dovetail region. This design has the effect of placing the pins in a location in the wheel where the stress level is reduced, thus allowing the addition of an airfoil in the opening over the closure block.

In its broader aspects, the invention relates to a closure bucket for a first stage turbine wheel comprising a root portion, a platform and airfoil, the root portion formed with a pair of radially inwardly extending laterally spaced tangs on either side of the root portion, the tangs each formed with a pair of radially aligned retaining pin holes.

In another aspect, the invention relates to a turbine wheel having a male dovetail configuration about substantially an entire periphery of the wheel, interrupted by a notch formed by removal of portions of the male dovetail at a bucket loading location on the periphery of the wheel; and a closure bucket comprising a root portion, a platform and airfoil, the root portion formed with a pair of radially inwardly extending laterally spaced tangs each formed with a pair of radially aligned retaining pin holes, the retaining pin holes located radially inwardly of the male dovetail configuration.

The invention will now be described in greater detail in connection with the drawings identified below.

DETAILED DESCRIPTION OF THE INVENTION

Figure 1:
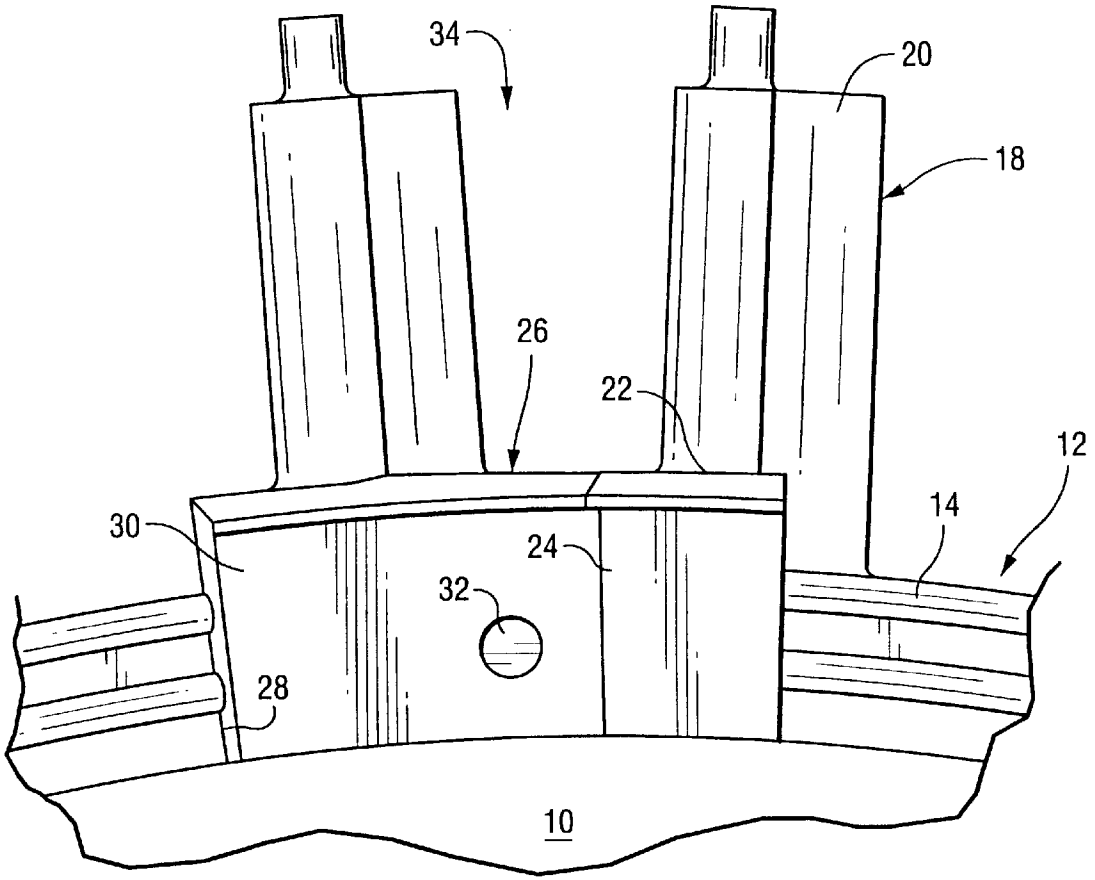
Fig. 1 (PRIOR ART)
FIG. 1 is a partial side elevation showing a conventional front stage closure bucket on a turbine wheel.

Referring to FIG. 1, a typical turbine rotor or wheel 10 (partially shown) includes a male dovetail configuration 12 formed about the periphery of the wheel, with upper and lower axial projections 14, 16 (projecting outwardly from both sides of the wheel) as conventionally provided. A bucket 18 having an airfoil 20, platform 22 and root or base portion 24 is shown loaded onto the wheel, and it will be understood that this is the last of a circumferential row of buckets to be loaded on the wheel. A closure block 26 is shown inserted within a notch 28, formed by removing the projections 14, 16 on opposite sides of the dovetail. A pair of tangs (one shown at 30) straddle the remaining core material of the dovetail, and a retaining pin 32 is press fit into aligned openings in the core and the tangs 30. Because the stresses at the location of pin 32 are high, the closure block 26 cannot support an airfoil, and thus an undesirable space 34 is left unfilled.

Figure 2:
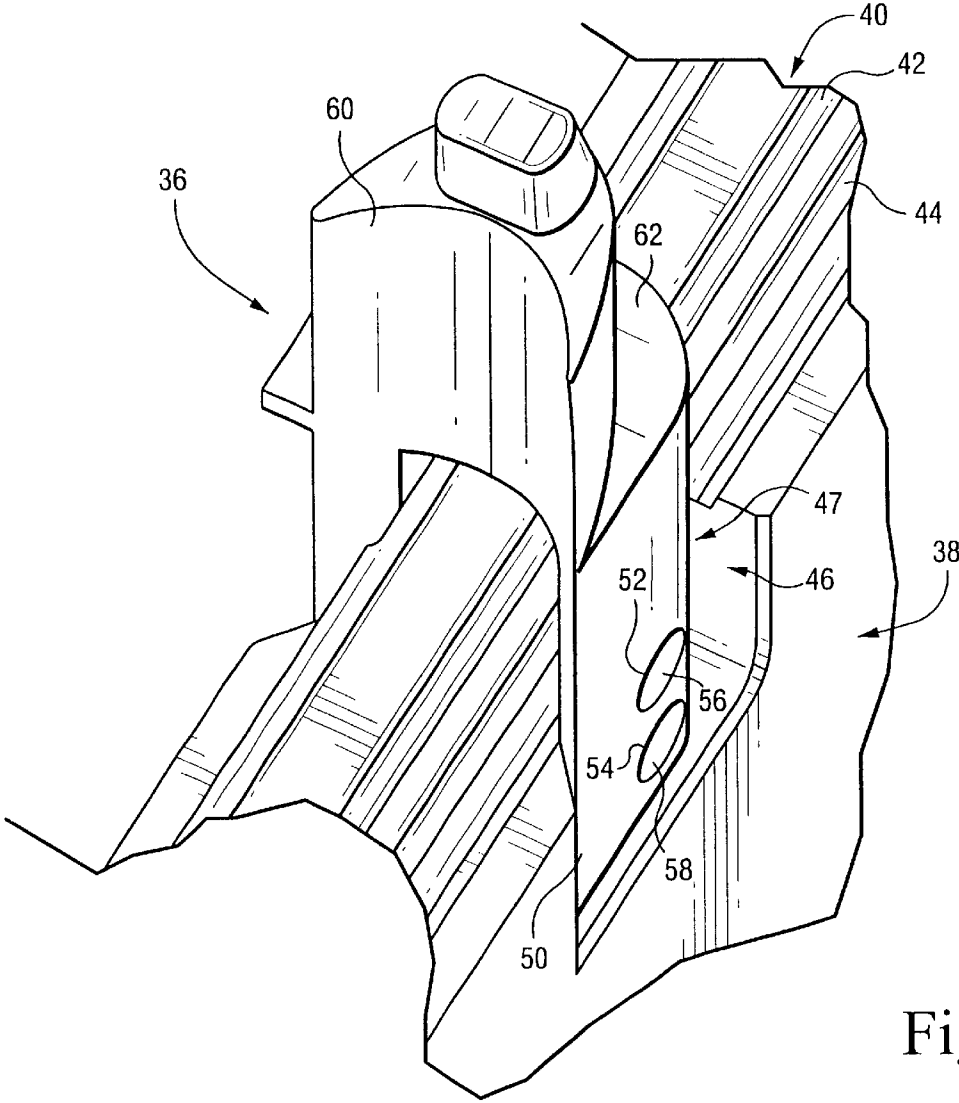
FIG. 2 is a partial perspective of a front stage closure bucket on a turbine wheel in accordance with an exemplary embodiment of the invention.
Figure 4:
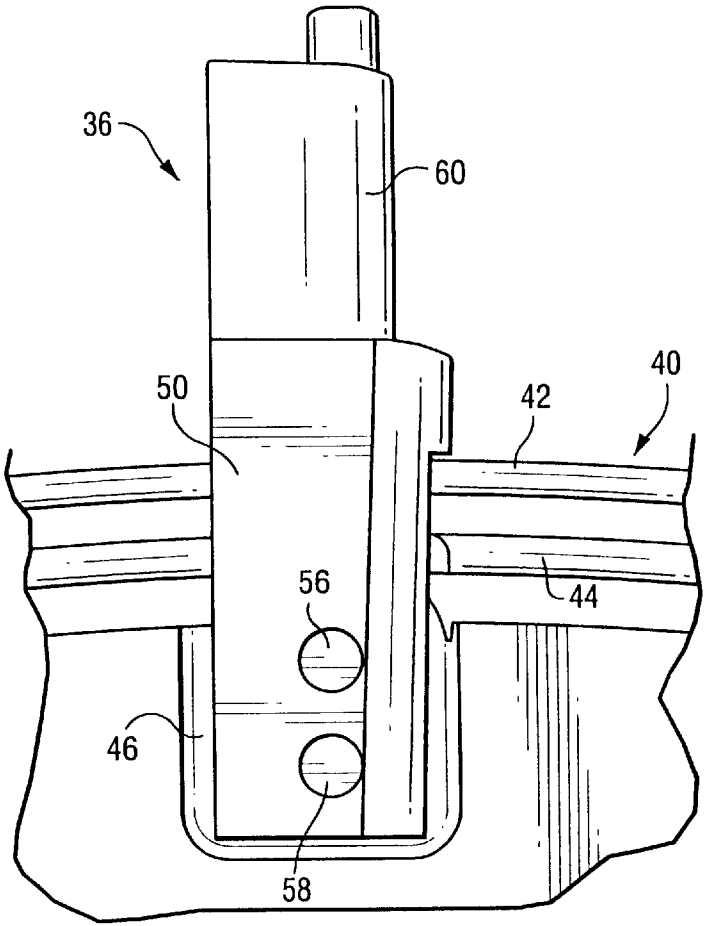
FIG. 4 is a partial front elevation of the closure bucket shown in FIG. 2 and 3.
Figure 3:
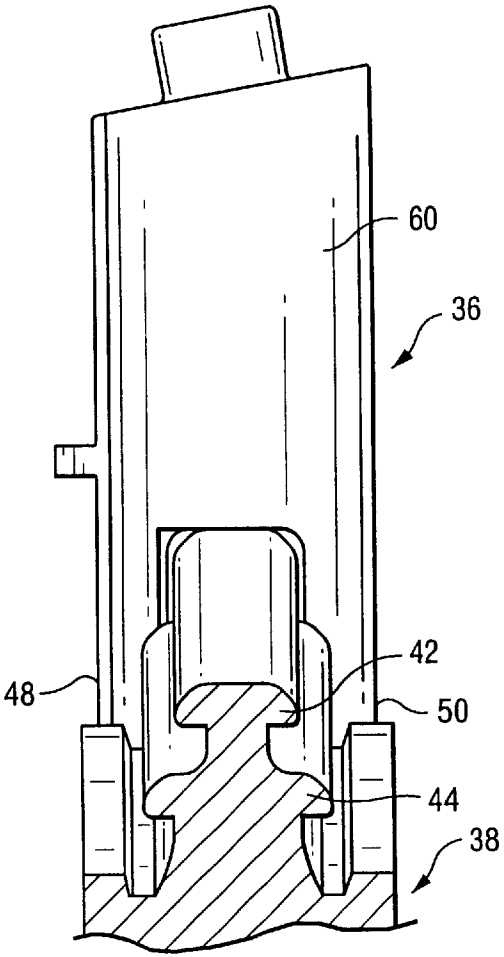
FIG. 3 is a partial side elevation of the closure bucket shown in FIG. 2.

With reference now to FIGS. 2–4, a closure bucket 36 in accordance with an exemplary embodiment of the invention is shown in place on a turbine wheel 38. Again, the periphery of the wheel is formed with a male dovetail 40 including projections 42, 44 that cooperate with complimentary female dovetails (not shown) formed in the buckets. The closure bucket 36 is inserted into notch 46, after all of the other buckets in the row are installed.

The notch 46 at the bucket loading location in the exemplary embodiment is deeper in a radial direction than presently formed notches (like notch 28), and the closure bucket 36 is formed with a root portion 47 that includes extended radial tangs 48, 50, each provided with a pair of radially aligned holes 52, 54 (one pair shown on tang 50). Holes 52, 54 of one tang are also axially aligned with the holes in the other tang. Because of the extended radial depth of the notch 46 and tangs 48, 50, radially aligned retaining pins 56, 58 used to secure the closure bucket 36 now pass through the core of the wheel 38 entirely radially inside the dovetail 40 formed on the periphery of the wheel. This arrangement provides the necessary increase in strength to allow the closure bucket to have an integral airfoil 60 located radially outwardly of the root portion 47 and the platform 62, thus filling the previously unfilled space (as at 34).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A closure bucket for a first stage turbine wheel with a dovetail formed on the periphery thereof, the closure bucket comprising a root portion, a platform and airfoil, the root portion formed with a pair of radially inwardly extending laterally spaced tangs on either side of the root portion, said tangs each formed with a pair of radially aligned retaining pin holes that, when the closure bucket is secured on the turbine wheel, are located radially inwardly of the dovetail.

2. The closure bucket of claim 1 wherein the pair of radially aligned retaining pin holes of one tang are axially aligned with the pair of radially aligned retaining pin holes of the other tang.

3. A closure bucket for a first stage turbine wheel comprising a root portion, a platform and airfoil, the root portion formed with a pair of radially inwardly extending laterally spaced tangs on either side of the root portion, said tangs each formed with a pair of radially aligned retaining pin holes;

wherein said tangs define an opening therebetween, said tangs adapted to straddle a core portion within a notch formed in a male dovetail on a turbine wheel.

4. A turbine wheel comprising a male dovetail formed on substantially an entire periphery of the wheel, interrupted by a notch formed by removal of portions of the male dovetail at a bucket loading location on the periphery of the wheel; and a closure bucket comprising a root portion, a platform and airfoil, the root portion formed with a pair of radially inwardly extending laterally spaced tangs, said tangs each formed with a pair of radially aligned retaining pin holes, said retaining pin holes located radially inwardly of said male dovetail.

5. The turbine wheel of claim 4 wherein the pair of radially aligned retaining pin holes of one tang are axially aligned with the pair of radially aligned retaining pin holes of the other tang.

6. The closure bucket of claim 5 wherein said tangs define an opening therebetween, said tangs adapted to straddle a core portion within said notch.

7. A turbine wheel comprising a male dovetail formed on substantially an entire periphery of the wheel, interrupted by a notch formed by removal of portions of the male dovetail at a bucket loading location on the periphery of the wheel; and a closure bucket comprising a root portion, a platform and airfoil, the root portion formed with a pair of radially inwardly extending laterally spaced tangs, said tangs each formed with a pair of radially aligned retaining pin holes, said retaining pin holes located radially inwardly of said male dovetail; wherein said tangs define an opening therebetween, said tangs adapted to straddle a core portion within said notch.

* * * * *